US007052445B2

(12) United States Patent
Ekhaus

(10) Patent No.: US 7,052,445 B2
(45) Date of Patent: May 30, 2006

(54) ADJUSTABLE EXERCISE BELL

(75) Inventor: Ira Ekhaus, 71 Glenburn Rd., Arlington, MA (US) 02476

(73) Assignee: Ira Ekhaus, Arlington, VA (US)

( * ) Notice: Subject to any disclaimer, the term of this patent is extended or adjusted under 35 U.S.C. 154(b) by 0 days.

(21) Appl. No.: 10/823,524

(22) Filed: Apr. 12, 2004

(65) Prior Publication Data

US 2006/0035767 A1 Feb. 16, 2006

Related U.S. Application Data

(60) Provisional application No. 60/462,464, filed on Apr. 11, 2003.

(51) Int. Cl.
*A63B 21/072* (2006.01)

(52) U.S. Cl. ..... 482/93; 482/108; 482/109

(58) Field of Classification Search ..... 482/20–22, 482/44, 49, 50, 79, 93, 94, 98, 104–109, 482/139, 908, 14, 92, 110, 148; D21/681, D21/682; 16/405, DIG. 8, 406, 408, 411, 16/422, 426, 430, 434
See application file for complete search history.

(56) References Cited

U.S. PATENT DOCUMENTS

| | | | | | |
|---|---|---|---|---|---|
| 850,964 | A * | 4/1907 | Pelletier et al. | 482/108 |
| 1,316,683 | A * | 9/1919 | Calvert | 482/93 |
| 1,917,566 | A * | 7/1933 | Wood | 482/108 |
| 1,991,520 | A * | 2/1935 | Postl | 482/108 |
| 2,398,436 | A * | 4/1946 | Mason | 220/752 |
| 4,021,040 | A * | 5/1977 | Inoue | 482/50 |
| 4,192,500 | A * | 3/1980 | Crow et al. | 482/50 |
| 4,351,526 | A * | 9/1982 | Schwartz | 482/108 |
| 4,431,185 | A * | 2/1984 | Cisneros | 482/93 |
| 4,627,618 | A * | 12/1986 | Schwartz | 482/108 |
| 4,659,079 | A * | 4/1987 | Blanchard | 473/60 |
| 4,681,315 | A * | 7/1987 | Yang | 482/50 |
| 4,743,017 | A * | 5/1988 | Jaeger | 482/108 |
| 5,735,779 | A * | 4/1998 | Lay | 482/93 |
| 6,387,022 | B1 * | 5/2002 | Smith | 482/106 |
| 6,569,066 | B1 * | 5/2003 | Patterson et al. | 482/99 |
| 2003/0162637 | A1 * | 8/2003 | Smithberg | 482/93 |

FOREIGN PATENT DOCUMENTS

| | | | |
|---|---|---|---|
| DE | 29711570 | U1 * | 9/1997 |
| JP | 05137815 | A * | 6/1993 |
| RU | 2001650 | C1 * | 10/1993 |
| SU | 1667880 | A2 * | 8/1991 |

OTHER PUBLICATIONS

Advertisement from "Barbell Exercises" by Chit Tun, pp. 23-27, 1927, Calcutta, India.*

* cited by examiner

*Primary Examiner*—Stephen K. Cronin
*Assistant Examiner*—Victor K. Hwang
(74) *Attorney, Agent, or Firm*—Chadbourne & parke LLP

(57) ABSTRACT

This invention pertains to an improved adjustable kettlebell that has a stack of standard weight plates, a rounded grip section, a support bar serving to hold the weight stack, and flexible attachment members with cutouts for the support bar. The flexible attachment members provide a mechanically compliant clamping arrangement to accommodate weight stack of varying widths, and the cutouts allowing adjustment to the relative distance between the grip axis and the support bar axis. The improved adjustable kettlebell of the current invention serves as a close physical approximation to a solid cast kettlebell with a wide combination of standard weight plates.

22 Claims, 4 Drawing Sheets

"REPLACEMENT SHEET"

ADJUSTABLE EXERCISE BELL

This application claims the benefit of Provisional application Ser. No. 60/462,464, filed Apr. 11, 2003.

FIELD OF THE INVENTION

The present invention relates to exercise equipment. More particularly, this invention pertains to an adjustable kettlebell of an improved, compact design that can employ standard barbell plates.

BACKGROUND OF THE INVENTION

In the specification, "dumbbell" defines an exercise device with two weight sections, connected by a handle section, while "kettlebell" defines a single mass section (often spheroidal) attached to single looped handle section. While many exercises can be performed with both kettlebells and dumbbells, some motions are more comfortably performed with a kettlebell or provide a unique benefit that is distinct from the nearest dumbbell equivalent. However, several kettlebell exercises such as the one arm clean (OAC) and the one arm snatch (OAS) require a degree of technique to avoid the kettlebell bashing against the user's forearm. The impact force is confined to a relatively small contact area, and bruising and discomfort can often result.

Limitations of Existing Adjustable Kettlebell Designs

In both the OAS and OAC exercise motions, a solid kettlebell provides a rounded surface that distributes both the impact and resting load of the kettlebell's mass. The primary disadvantage of a solid kettlebell design is that several kettlebells of varying weights are required to accommodate a range of exercises and strength levels. Previous adjustable kettlebell designs have had deficiencies in that they employ nonstandard weights and/or fail to provide adequate roundedness and comfort in the final configuration.

A first adjustable kettlebell design was created by CALVERT (described in U.S. Pat. No. 1,316,683 issued to Milo Barbell Company). It comprises a handle attached to an outer shell surrounding a set of specialized weights. The following features and deficiencies of the design used in CALVERT are addressed by the improvements of the present invention. In CALVERT, (1) non-standard weight plates are required; and (2) the handle clearance, the distance between the handle and the point of contact between the forearm and the mass section, is fixed.

Another adjustable type of kettlebell design is WOOD (described in U.S. Pat. No. 1,917,566 issued to Robert Alfred Wood). WOOD describes four major configurations of prior art designs. WOOD describe a design with an accommodation for standard barbell plates inside of an outer shell. Wood discloses the two cups of the outer shell with the edges presented outwards. WOOD also discloses a continuous stack of plates secured by collars to a bar, all within the confines of the attachment member. In another configuration, WOOD discloses a modified form of the handle, assembled with several of the discs at each end of the bell configuration, the cup members being omitted.

WOOD does not reveal or describe several important features, namely, (1) a configuration that approximates the smooth surfaces found in the solid forged kettlebell without requiring a separate outer shell member; (2) a configuration where plates of the weight stack straddle the attachment members; (3) a configuration free of stop collars which avoids wide, awkward protrusions; and (4) a "solid" configuration that prevents sway of the main weight section with regard to the handle, along with an attachment mechanism that provides for an adjustable handle clearance. While WOOD contemplates a configuration with a solid handle (a wire bail), it does not describe a means to combine the solid handle with an adjustable handle clearance. Furthermore, adding additional chain links to the configurations described by WOOD will only increases the relative sway.

Another design for an adjustable kettlebell was implemented by GRACE (Gracefitness). It involves a gnurled handle, a set of specialized bevel discs, and a set of twisted steel bars functioning as a means of attachment between the weight discs and the gnurled handle. The following features and deficiencies of the GRACE design are addressed by the improvements of the present invention. GRACE requires (1) specialized beveled plates are required to form the rounded surface near the line of contact; (2) that the handle clearance is a fixed distance from the contact point; and (3) the plate axis is perpendicular the handle's axis, hence adjusting the number of weights changes the point of contact.

Two more adjustable designs that use standard barbell plates, are manufactured by Piedmont Design Associates (PDA). The deficiencies of the PDA designs are as follows: (1) the use of retaining collars results in significant gaps in the spacing of the weight plates that straddle the attachment member; (2) the use of retaining collars results in significant protrusions on the outside of the bell configuration; (3) the handle clearance between the handle and the bar is fixed. Another kettlebell design has been designed by IRONMIND (Ironmind). It implements the plate axis to be perpendicular to the handle axis, but requires careful consideration of the weight stack configuration to avoid having the weight plate edges come to rest with the forearm during some exercises. This design and instructions from manufacturers indicate their awareness of the shortcomings of this arrangement and discourage all exercise motions that involve the weight resting on the forearms.

SUMMARY AND OBJECT OF THE INVENTION

In light of the deficiencies, shortcomings and drawbacks of the known kettlebell designs, it is therefore an object to provide an improved kettlebell weightlifting device which includes an adjustable configuration that provides for a plurality of standard weight discs forming a weight stack with a central plate axis.

It is further object of the current invention to provide a supporting bar aligned along the plate axis, this axis being nominally parallel to the axis of the grip section of the handle.

It is another object of the current invention to provide a rounded grip section that affords comforting grip to the user.

It is also an object of the current invention to provide attachment members that afford significantly reduced gaps between weight discs that straddle said attachment sections.

It is further desirable that these attachment members are structured as to provide an adjustable distance between the grip section and the plate axis.

These and other objectives, characteristics and advantages of the present invention will be disclosed in more detail with reference to the attached drawings.

DETAILED DESCRIPTION OF THE INVENTION

Figure 1A:
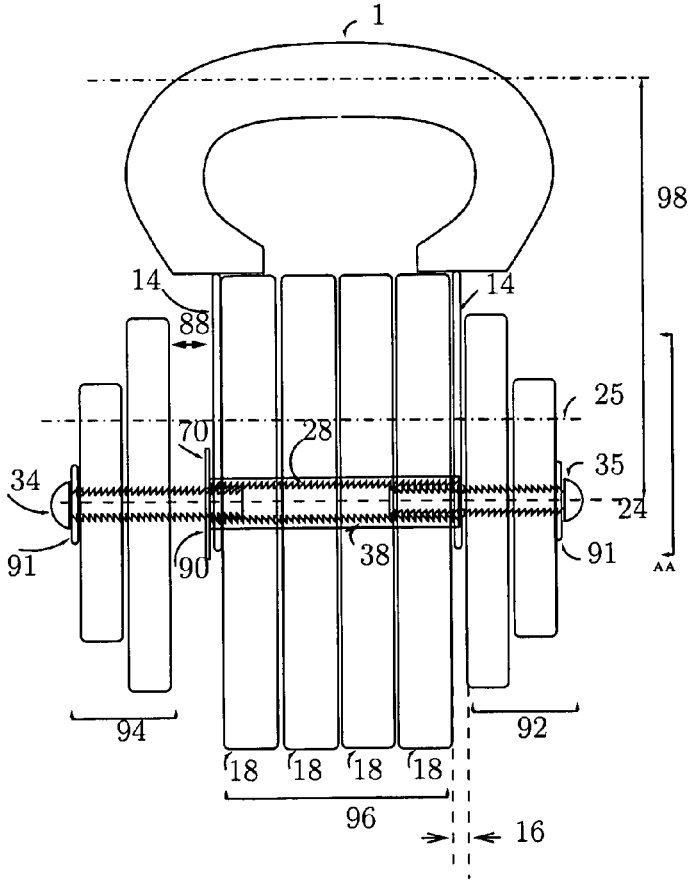
FIG. 1A is a partially exploded elevation view of one embodiment of the present invention.

FIG. 1A shows an elevation view of one embodiment of the present invention in partial disassembly. A curved and rounded handle assembly is comprised of a grip section 1 and an attachment member or "blade" 14. The "blade" 14 has an asymmetric cross-section and intersects the stack of disc weights 18 with a minimal gap 16 introduced between weight plates. For example, the attachment member in FIG. 1A illustrates an asymmetric cross-section, wherein the attachment member is formed with a cross-section that has a greater breadth in a direction perpendicular to a weight plate axis than in a direction parallel to the weight plate axis. The subassembly of the bolts 34, 35, washers 91 and the elongated nut 28 forming a support bar 70 for the weight stack.

In this particular embodiment, an elongated hexnut 28 with a captive washer 90 welded to one end, is passed through a central disc stack 96 from the left until the captive washer 90 meets the outside face of the left blade, while the right bolt 35 is passed through an outside washer 91 and rightmost weight assembly 92 and threaded into the hexnut 28 from the right, and the left bolt 34 is passed through the leftmost weight assembly 94 and threaded into 28 from the left. As the bolts are tightened down, the gap 88 between the outside weight assemblies 94 and 92 and center weight stack 96 reduces to the thickness of the attachment members 14—the final configuration forming a single, physically tight assembly. The subassembly of the bolts 34, 35 and the elongated hexnut 28 forming a support bar 70 assembly for the weight stack. Section AA #1 shows the cross section of the blades 14 with distinct holes 20 for different positions of the bar. Section AA #2 shows the cross section of the blades 14 with a scalloped hole pattern 22 that provide for a finer adjustment of support bar positions. The adjustable hand clearance 98 feature is demonstrated with the center line 24 aligned with holes AA #1, and the center line 25 aligned with sections AA #2. Distinct holes 20, or small nibs 23 in the hole pattern 22 can provide a hard mechanical stop for the hexnut 28. Alternately, the design can rely solely on the friction of a tightened support bar to set and maintain a specific handle clearance 98.

In FIG. 1A, the support bar 70 is comprised of the left bolt 34, elongated nut 28 with captive washer 90 and right bolt 35. With various combinations of outside bolts (34 and 35) and a 4" long hexnut 28, the length of the support bar can safely span a range of 4" to 10". Other features of this invention may include the following additional elements:

1) since the captive washer 90 provides access to the internal thread of the hexnut 28, the right weight assembly 92 can be modified without rearranging either the core 96 or the left weight assembly 94;
2) additional combinations of inside and outside bolts can provide additional lengths, if necessary;
3) either or both outside weight assemblies may be omitted.

Alternately, the support bar can be configured as a variety of other mechanical arrangements that effectively result in a shaft of adjustable length. Moreover, a support bar can be comprised of a solid or hollow tube along with standard securing mechanisms, such as spring, spiral clamps or large pitch spiral threads, with the proviso that such configurations can introduce additional protrusions past the outside weight assemblies.

Figures 1B, 1C:
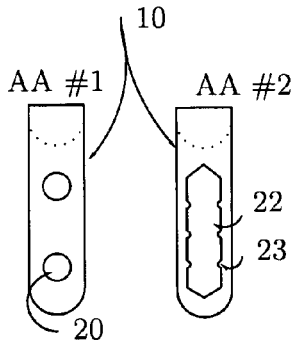
FIG. 1B is a side view of an implementation of an attachment member illustrated in FIG. 1A from the perspective of reference character AA.
FIG. 1C is a side view of another implementation of an attachment member illustrated in FIG. 1A from the perspective of reference character AA.

By defining an attachment member 10 with various hole configurations of 20 or 22 (see FIG. 1A–1C) the present invention allows for an adjustment of the distance between support bar 70 axis 24 and the grip axis, and provides the key improvement that the user can adjust the optimum contact point 32 independently of the diameter of the weight plates that are used.

Figure 2:
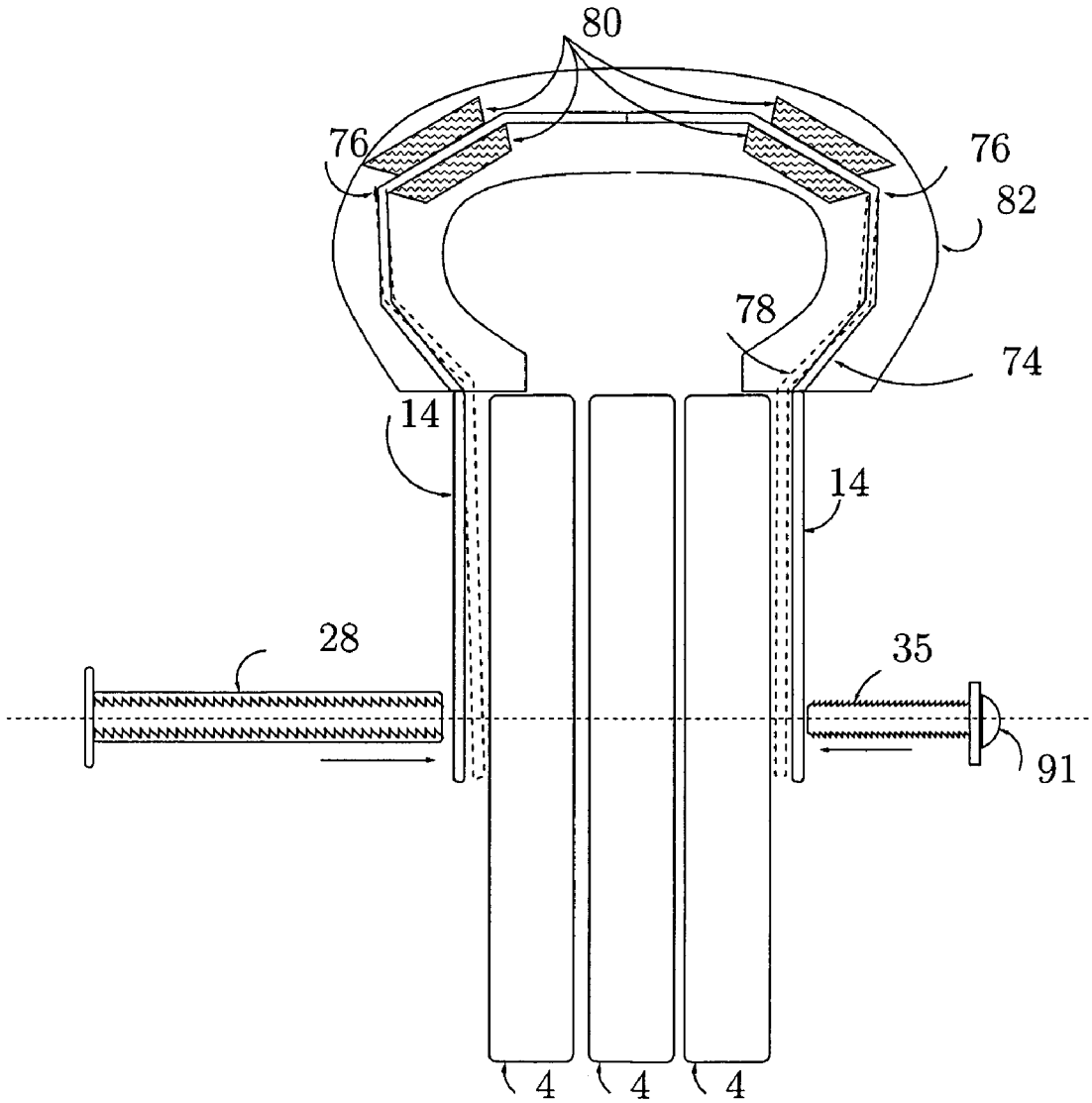
FIG. 2 is an elevation view of the present invention highlighting the flexure of the attachment structure.

FIG. 2 illustrates another aspect of the present invention. The blade section 14 is part of a single piece of bent spring material 74 (preferably spring steel), that is embedded in a partially hollow grip-section 1 with outside profile 82. In the implementation in FIG. 2, because the attachment members are formed from a springy material, the attachment members have an inherent resilient mechanical compliance, as well as an asymmetric mechanical compliance. Further, in the FIG. 2, a bar 74 is bent to a profile that fits snugly against the internal webs 80 of an otherwise hollow grip section 1 which could be constructed by joining two halves of either stamped metal or molded material (for example, ABS plastic). The internal webs 80 function to secure part of the bar member 74 between pivot points 76. In the implementation in FIG. 2, the attachment members are formed with an internal pivot point 76. Below the pivot points 76, there is an internal clearance 98 that allows the bar 74 to flex within the hollow grip-section 1.

As the bolt 35 is threaded against the elongated hexnut 28, the blades 14 flex into a new profile 78. Additionally, if the nominal hex pattern 22 is cut into the blade attachment members 14, then the hexnut 28 can be restrained from spinning even if the core weight stack 96 width is greater than the hexnut's length. This safety feature prevents the inadvertent loosening of one bolt while the user tightens the other bolt. Additionally, by setting the pivot point 76 far from the bottom of the grip-section 1, the present invention achieves greatly increased mechanical compliance of the blades 14, allowing the blades to clamp tightly against a central plate assembly 96 of varying width without excessive stress being placed on the blades or the grip-section 1.

Figure 3:
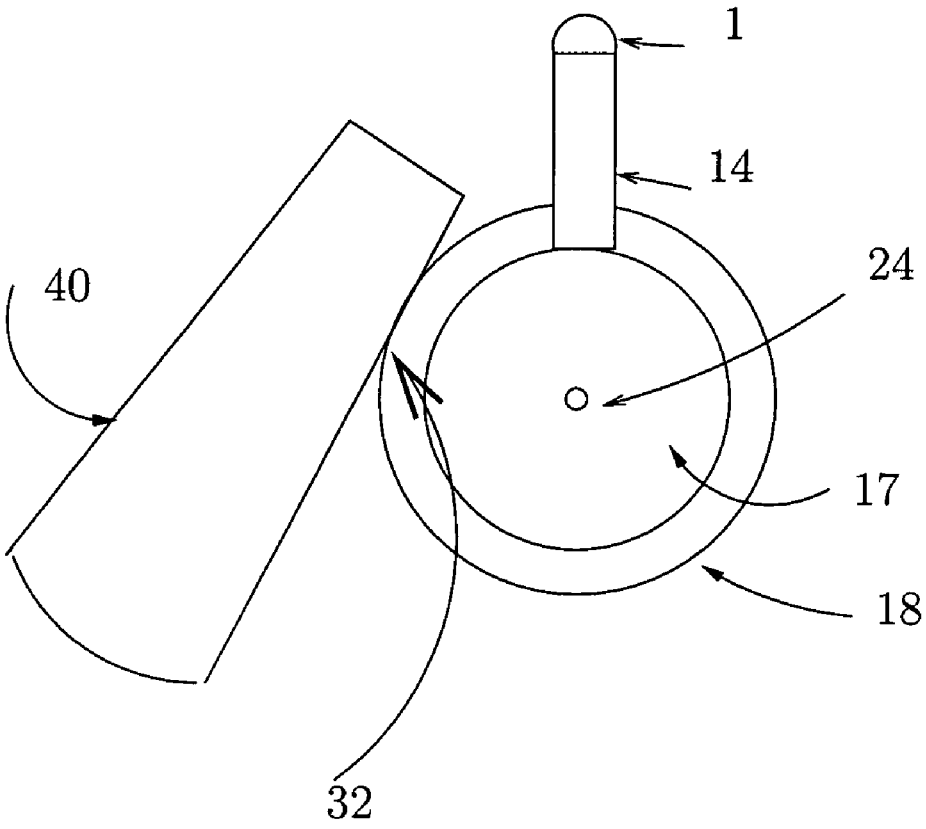
FIG. 3 is a side view of one embodiment of the present invention, showing the rounded handle, weight discs, and the "forearm".

FIG. 3 shows the side view of the kettlebell configuration, with a grip-section 1 leading into the attachment member blades 14 that intersperse the weight stack. The inner stack of weights is comprised of larger weight discs 18 (e.g., 10 pounds), while the outer edges of the stack are comprised of smaller weight discs 17 (e.g., 5 pounds).

In this view, the contact point 32 between the forearm 40 and the weight stack shows the critical nature of the hand clearance (the distance between the support bar axis 24 and the grip axis). If this clearance is too small then the weight's leverage against the wrist can impose excessive pressure at the contact point. If this clearance is too large, then the flipping action (described in the OAS and OAC motions above) of the kettlebell allows for excessive acceleration of the weight stack prior to terminating at the contact point 32.

Figure 4A:
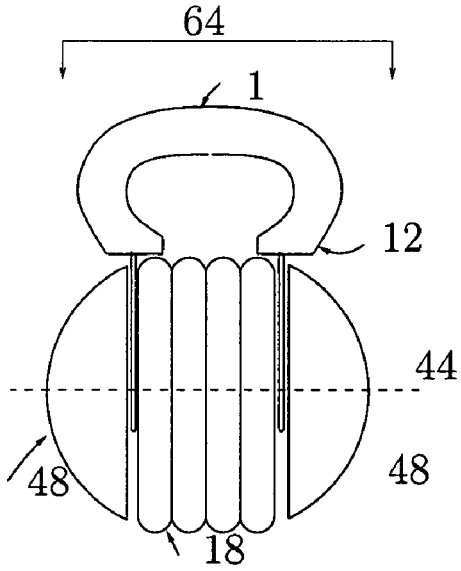
FIGS. 4A–4C are a schematic representation of the present invention, showing three additional configurations in accordance with the current invention, showing a narrow configuration with large plates and hemispherical end caps in FIG. 4A, a narrow configuration with small plates and hemispherical end caps in FIG. 4B, and a narrow configuration with small plates, hemispherical end caps and a protective band in FIG. 4C.
Figure 4B:
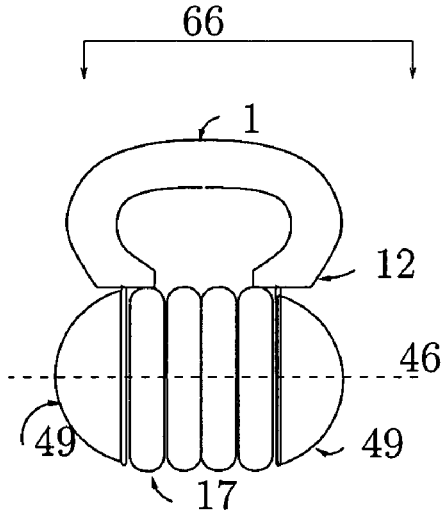
Figure 4C:
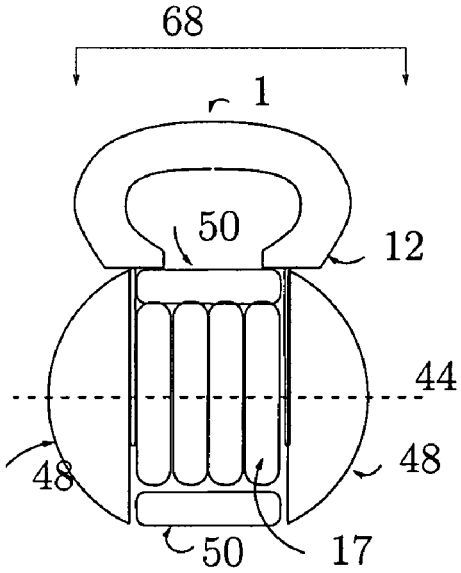

FIGS. 4A–4C show some additional configurations of the present invention. Configuration 64 in FIG. 4A shows a weight stack comprised of four ten pound discs 18 along with hemispherical end caps 48 all aligned on centerline axis 44. The hemispherical end caps 48 would have a deep countersunk hole that would allow for bolt head and support bar (not shown in this drawing) to pass through the majority of the hemispherical end cap. The final configuration nearly approximates the hemispherical shape of the original solid kettlebell. The hemispherical end caps could be made of any material. A metal cap would provide additional weight, while caps made of plastic, foam, wood or other light material provide the desired shape without significant addition weight or requirement for a specialized forging.

Configuration 66 in FIG. 4B, shows a weight stack comprised of four 5 pound discs 17 along with smaller hemispherical end caps 49 all aligned on centerline axis 46. Substantially less weight is involved (20 vs 40 pounds), but the optimal contact point is preserved by adjusting the centerline 46. The smaller hemispherical end caps 49 have all the characteristics of their larger counterparts 48 in configuration 64.

Configuration 68 in FIG. 4C, shows a weight stack comprised of four 5 pound discs 17 along with the larger hemispherical end caps 48, and a protective band 50 around the weight stack, all aligned on centerline axis 44. The weight stack of 17, spherical end caps 48 and protective band 50 comprising an entirely spheroidal shape of relatively low weight and large size, are envisioned for the less aggressive user. The hemispherical caps and/or protective band can be manufactured out of a dense shock absorbing foam for additional comfort and protection.

While there have been shown and described, pointed fundamental novel features of the invention as applied to embodiments thereof, it will be understood that various omissions and substitutions and changes in the form and details of the invention, as herein disclosed, may be made by those skilled in the art without departing from the spirit of the invention. In particular all weights and dimensions introduced in the specification were presented for illustrative purposes, and variations in said weights and dimensions are anticipated and will not affect the utility of the present invention. It is expressly intended that all combinations of those elements and/or method steps which perform substantially the same function in substantially the same way to achieve the same results are within the scope of the invention. It is the intention, therefore to be limited only as indicated by the scope of the claims appended hereto.

I claim:

1. An adjustable kettlebell comprising:

a handle with a grip section having a grip section axis;

two or more attachment members extending from the handle, wherein the two or more attachment members are configured as blade-like attachment members formed from a springy material to be deformable between a first position and a second position with a resilient mechanical compliance with respect to the handle;

a support bar, aligned along a weight plate axis, substantially parallel to the handle grip section axis, wherein the support bar is configured to support at least one weight plate between the attachment members; and at least one weight stack.

2. The device of claim 1, wherein said attachment members resiliently deflect to clamp tightly against a variety of weight stack widths.

3. The device of claim 1, wherein a segment of said attachment members can flex within the grip section.

4. The device of claim 1, wherein said supporting bar has a smooth overall profile lacking in excessive protrusions.

5. The device of claim 1, wherein said supporting bar comprised a bolts/washer combination tightened on either side of elongated nut.

6. The device of claim 1, wherein said supporting bar comprises an elongated nut, a captive washer and at least one bolts/washer combination.

7. The device of claim 1, having a roughly hemispherical end caps to further approximate a spheroidal shape of a solid kettlebell.

8. The device of claim 1, wherein a protective band surrounding the weight stack accommodates different form factors and provides additional padding.

9. The adjustable kettlebell in claim 1, wherein the two or more attachment members are each configured with an asymmetric cross-section.

10. The adjustable kettlebell in claim 9, wherein the asymmetric cross-section is configured with a greater breadth in a direction perpendicular to the weight plate axis then in a direction parallel to the weight plate axis.

11. The adjustable kettlebell of claim 1, wherein the two or more attachment members are configured with an internal pivot point.

12. The adjustable kettlebell of claim 1, wherein the two or more attachment members are configured with an asymmetric mechanical compliance.

13. The adjustable kettlebell of claim 1, wherein the two or more attachment members are configured to provide an adjustable distance between the grip section and the weight plate axis.

14. An adjustable kettlebell, comprising:

a handle having a grip section with a grip section axis, two or more attachment members extending from the handle, a support bar, wherein the support bar is configured to support at least one weight plate between the attachment members, at least one weight stack, wherein the two or more attachment members are configured as blade-like attachment members formed from a springy material to be deformable between a first position and a second position with a resilient mechanical compliance with respect to the handle and said supporting bar is aligned along a weight plate axis, nominally parallel to the axis of the grip-section of the handle; and wherein said attachment members are configured to provide an adjustable distance between the grip section and the weight plate axis.

15. The device of claim 14, wherein said attachment members resiliently deflect to clamp tightly against a variety of weight stack widths.

16. The device of claim 14, wherein a segment of said attachment members can flex within the grip section.

17. The device of claim 14, wherein said supporting bar has a smooth overall profile lacking in excessive protrusions.

18. The device of claim 14, wherein said supporting bar comprised a bolts/washer combination tightened on either side of an elongated nut.

19. The device of claim 14, wherein said supporting bar comprises an elongated nut, a captive washer and at least one bolts/washer combination.

20. The device of claim 14, having a roughly hemispherical end caps to further approximate a spheroidal shape of a solid kettlebell.

21. The device of claim 14, wherein a protective band surrounding the weight stack accommodates different form factors and provides additional padding.

22. An adjustable kettlebell, comprising:

a handle with a grip section having a grip section axis, two or more attachment members, a support bar, at least one weight stack, wherein the two or more attachment members are configured as blade-like attachment members formed from a springy material to be deformable between a first position and a second position with a resilient mechanical compliance with respect to the handle and said support bar is aligned along a weight plate axis, which is nominally parallel to a handle grip-section axis and support bar is configured to support at least one weight plate between the attachment members; and wherein said two or more attachment members are configured to provide an adjustable distance between the grip section and the plate axis, and wherein said two or more attachment members are flexibly configured to clamp tightly against weight stack of different widths.

* * * * *